United States Patent [19]

Giger

[11] Patent Number: 4,819,807

[45] Date of Patent: Apr. 11, 1989

[54] TEAR-STRIP OPENING ENVELOPE APPARATUS

[76] Inventor: Charles Giger, 658 Hillcrest, Elmhurst, Ill. 60126

[21] Appl. No.: 141,112

[22] Filed: Jan. 5, 1988

[51] Int. Cl.[4] ..... B65D 27/38

[52] U.S. Cl. ..... 206/610; 206/632; 229/80; 229/81

[58] Field of Search ..... 206/610, 613, 632, 631, 206/633; 229/81, 80

[56] References Cited

U.S. PATENT DOCUMENTS

| | | | |
|---|---|---|---|
| 96,566 | 11/1869 | Eberman | 206/632 |
| 754,201 | 3/1904 | Davalos . | |
| 890,538 | 6/1908 | Stillwell . | |
| 2,088,068 | 7/1937 | Overbaugh, Jr. | 206/610 |
| 2,332,637 | 10/1943 | Heywood | 229/80 |
| 3,070,280 | 12/1962 | Richmond | 206/632 |
| 3,239,128 | 3/1966 | Rumberger | 206/613 |
| 3,310,225 | 3/1967 | Hoblit et al. | 229/80 |
| 3,327,928 | 6/1967 | Green | 229/80 |
| 3,733,025 | 5/1973 | Hicrsteiner | 206/610 |
| 3,982,689 | 9/1976 | Retrum | 206/610 |
| 4,166,539 | 9/1979 | Allen et al. | 206/632 |
| 4,607,749 | 8/1986 | Jacob | 206/610 |

FOREIGN PATENT DOCUMENTS

| | | | |
|---|---|---|---|
| 635035 | 7/1933 | Fed. Rep. of Germany | 229/80 |
| 659043 | 6/1929 | France | 206/610 |
| 197869 | of 1938 | Switzerland | 206/610 |

*Primary Examiner*—David Fidei

*Attorney, Agent, or Firm*—Dick and Harris

[57] ABSTRACT

A tear-strip opening envelope apparatus is provided with a tear-strip opening feature for facilitated closing, sealing, opening and emptying thereof. A tear-strip is located on each of two panels enclosing the sides of the envelope, with each of the tear-strips attachably overlying the other in close alignment, upon sealing of the envelope. The attached aligned tear-strips create a single multi-ply tear-strip assembly which facilitates the opening and emptying of the envelope. Opening of the tear-strip opening envelope apparatus is accomplished by pulling the reinforced multi-ply tear-strip member, at an end thereof, across the tear-strip opening envelope.

19 Claims, 1 Drawing Sheet

TEAR-STRIP OPENING ENVELOPE APPARATUS

BACKGROUND OF THE INVENTION

The present invention relates in general to envelope apparatus, and in particular to a tear-strip opening envelope apparatus for the protective maintenance of enclosures therewithin, which apparatus is configured for the facilitated closing, sealing, opening and emptying thereof.

A typical prior art envelope apparatus comprises, in part, a single piece envelope blank having a centrally positioned rectangular section comprising the front panel of the envelope. The front panel is typically rectangular in shape and has emanating from the sides thereof, contiguously formed panels comprising back, top, and side panels which are folded toward and behind the front panel along fold lines. Typically, the back panel which emanates from the front panel is of a size and configuration substantially equal to that of the front panel so that when the back panel is folded over toward the front panel, a contents enclosure region is thereby defined. Emanating from a side of the front panel opposite that from which the back panel emanates is a top panel which is configured so as to cover, when folded over the front panel toward the back panel, the opening giving access to the contents enclosure region. In order to enable sealing of the envelope apparatus, an adhesive material is typically disposed upon a side of the top panel which, when folded over and toward the back panel, faces the back panel.

The previously mentioned side panels, which emanate from the sides of the front panel between the top and back panels, provide added enclosure, on those respective sides, of the envelope contents enclosure region. In order that the enclosures may be securely contained within the envelope apparatus, such as when the envelope is used to mail items, or for other security uses, the adhesive material typically used permanently bonds the adjacent surfaces between which the adhesive is positioned. However, in certain circumstances, such as in a business setting wherein large volumes of mail are handled, it may be desirable to enable an envelope, such as been described, to be opened quickly and easily without the use of an implement, such as a letter opener, in order to gain access to the enclosures within.

One such envelope of the prior art which attempts to accomplish this, is U.S. Pat. No. 890,538 to Stillwell, which teaches an envelope formed from a folded cross-shaped blank having a front panel, two oppositely arranged side panels, a rear panel and a top panel. A tear-strip is formed when the top panel is sealed against the rear panel and a portion of the top panel bonds by adhesive to a perforated tab projecting from the back panel. When the tab is pulled in the direction of the top edge of the top panel, the tab separates from the rear panel and tears the top panel along two lines of perforation extending at diverging oblique angles toward the top edge of the envelope. However, the envelope apparatus disclosed in Stillwell '538 has the following potential drawback. Once the tab is pulled and the top panel is torn, an opening is created through which the contents of the envelope may be examined. However, the contents may not be removed because the opening thus created extends along only a small portion of the top edge of the envelope, necessitating a second opening movement, either with a letter opener or other tool, in order to create an aperture in the top of the envelope sufficiently large to permit removal of the enclosures inside. Furthermore, when this additional opening movement is accomplished, the Stillwell '538 envelope is no longer capable of retaining the enclosures, for example, if it were desired to utilize the envelope as a storage means, since no top panel remains intact, after opening of the envelope, to prevent any enclosures within from falling out.

Another prior art envelope having a tear-strip is that disclosed by U.S. Pat. No. 4,607,749 to Jacob. Jacob '749 teaches an envelope formed from a single piece multi-panel blank in which a portion of the blank defining the rear panel of the envelope has a tear-strip formed by a line of perforations extending across the entire width of the rear panel, a central section of the perforations defining a pull tab. However, although this tear-strip is overlapped and adhered to by a top panel, the top panel has no tear-strip formed on it. Therefore, when the pull tab is pulled, ruptures occur along the perforation, opening the envelope, and leaving the top panel attached to the envelope, with the tear-strip from the rear panel adhering to the top panel. While Jacob '749 teaches an envelope apparatus which may be opened with a single motion, and leaves a top panel section intact, enabling later use of the envelope as a storage means, because the opening motion is one done in a direction normal to the line of perforations, it is possible that tearing of the top panel in the direction perpendicular to the perforations may occur, thus impairing the later use of the envelope as a storage means.

Still another envelope apparatus of the prior art having a tear-strip is U.S. Pat. No. 754,201 to Davalos. Davalos '201 teaches an envelope having a reinforced tear-strip formed on the top panel, a substantial distance away from and parallel to the top edge of the envelope. However, the tear strip in Davalos '201 is formed only upon a single panel. A slit is provided which extends along the tear-strip, in order to facilitate tearing of the closure panel in order to gain access to the contents. However, only one cut is provided, and is positioned on that side of the tear-strip which is toward the end of the top panel which is affixed to the back panel of the envelope. Thus, when the tear-strip is utilized, the remaining portion of the closure panel may be torn unevenly, thus hindering use, if desired, of the envelope as a storage means.

It is desirable to provide an envelope apparatus which may be quickly and neatly opened by means of a tear-strip provided therein, which tear-strip may be utilized with a single opening movement and which is less likely to tear the envelope in an unintended manner during opening, while leaving the envelope in a condition suitable for reusing the envelope as a storage means if so desired.

Accordingly, it is an object of this invention to provide an envelope apparatus having a reinforced tear-strip formed thereon for the facilitated, quickly accomplished, and non-destructive opening of the envelope apparatus.

It is a further object of the present invention to provide a tear-strip opening envelope apparatus comprised of a single envelope blank including a centrally positioned front panel section, a back panel section formed contiguously with the front panel section and emanating from a side thereof, a top panel section formed contiguously with the front panel section and emanating from a side thereof opposite the back panel section, the top and back panel means having emanating therefrom top and back panel tear-strip means, respectively, which, when said top and back panel means are folded over the front panel means toward each other, are positioned in substantially overlying relation relative to one another to form a reinforced multiply tear-strip for the facilitated opening of the tear-strip opening envelope apparatus.

An additional object of the invention is to provide a tear-strip opening envelope apparatus wherein lines of perforation extend between the top panel tear-strip means and top panel means, and between the back panel tear-strip means and back panel means, such that when the reinforced multi-ply tear-strip member is formed upon sealing of the envelope, removal of the reinforced multi-ply tear-strip member may be accomplished neatly, quickly and without unnecessary or undesired tearing of other portions of the envelope apparatus.

Yet another object of the invention is to provide such a tear-strip opening envelope apparatus wherein removal of the reinforced multi-ply tear-strip from a sealed envelope apparatus, according to the present invention, leaves the top panel means intact so that the tear-strip opening apparatus may be utilized as a storage means thereafter.

It is a still further object of the invention to provide a tear-strip opening envelope apparatus utilizing, as an adhesive means for sealing the envelope apparatus, a layer of fugitive glue operably disposed upon each of the back and top panel tear strip means and wherein at least one of the back and top panel tear-strip means is folded away from the other in order to prevent inadvertent and accidental sealing of one to the other before use.

These and other objects of the invention will become apparent in light of the present specification, drawing and claims.

SUMMARY OF THE INVENTION

The present invention comprises a tear-strip opening envelope apparatus for the protective maintenance of enclosures therewithin, which envelope is configured for the facilitated closing, sealing, opening and emptying thereof as well as for subsequent storage of these enclosures. The tear-strip opening envelope apparatus comprises front panel means having a top and bottom side opposite one another and back panel means having a top and bottom side opposite one another. The back panel means and the front panel means are positionable in substantially overlying relation to one another and are joined along at least a substantial portion of their respective bottom sides to define a contents enclosure region. A remaining unjoined portion proximate to the respective top sides of both of the front and back panel means defines a contents insertion region substantially opposite to the joined bottom sides.

The tear-strip opening envelope apparatus includes back panel tear-strip means which operably emanate from the back panel means for covering at least a portion of the contents insertion region. Top panel means operably emanate from the top side of the front panel means for covering at least a portion of the contents insertion region when the top panel means is folded back toward the back panel means. Top panel tear-strip means are operably positioned along at least a portion of the top panel means.

The back panel tear-strip means and the top panel tear-strip means, when the top and back panel means are juxtapositioned, are disposed in substantially aligned coextensive and thus congruent overlying relation relative to each other. Adhesive means are operably positioned between the overlying regions of the back panel tear-strip means and top panel tear-strip means, to restrainably affix the back panel tear-strip means to the top panel tear-strip means, for sealing the top and back panel means to each other and, in turn sealing the envelope apparatus with the enclosures therewithin, while simultaneously forming a reinforced multi-ply tear-strip member for facilitated opening of the envelope apparatus. The sealed tear-strip opening envelope apparatus is openable by grasping the reinforced multi-ply tear-strip member at a first end thereof and by pulling the first end across the apparatus until the reinforced multi-ply tear-strip member is separated from the apparatus to the extent necessary to expose the enclosures for facilitated removal thereof.

The tear-strip opening envelope apparatus, in its preferred embodiment, further comprises side panel means operably emanating from at least one of the front and back panel means, between the respective top and bottom sides thereof, for operable positioning between the front panel means and the back panel means, toward further enclosing the contents enclosure region. In this preferred embodiment of the invention, the front panel means comprises a substantially rectangular panel. The back panel means comprises a substantially rectangular panel having a width substantially equal to that of the front panel means and having a height substantially less than that of the front panel means. The rear panel means is formed contiguously with the front panel means along a fold line positioned at the bottom sides of the front and back panel means. Folding the contiguously formed front and back panel means along the fold line towards each other, positions the front and back panel means in the substantially overlying position relative to each other.

In the preferred embodiment of the invention, the back panel tear-strip means comprises a substantially rectangular strip formed contiguously with the back panel means and having at least one line of perforations extending therebetween. In this embodiment, the line of perforations extends to at least one side of the back panel means and the back panel means and back panel tear-strip means have, operably disposed therebetween, at said side, a notch for facilitating the grasping and pulling of the reinforced multi-ply tear-strip member across the tear-strip opening envelope apparatus. The top panel means is formed contiguously with the front panel means along a fold line positioned at an unjoined portion of the common peripheral region of the front and back panel means. Folding the top panel means along the fold line toward and over the back panel means prompts the top panel means to cover at least a portion of the envelope contents insertion region. In this preferred embodiment of the invention, the top panel tear-strip means comprises a substantially rectangular panel formed contiguously with the top panel means and having at least one line of perforations extending therebetween. The line of perforations extend to at least one side of the top panel means, and the top panel means and the top panel tear-strip means have, operably disposed therebetween at said side, a notch for facilitating the grasping and pulling of the reinforced multi-ply tear-strip member across the tear-strip opening envelope apparatus.

In one embodiment of the invention, the adhesive means comprises a layer of fugitive glue operably disposed upon each of the top panel tear-strip means and the back panel tear-strip means so as to restrainably affix same to each other when the top panel tear-strip means and the back panel tear-strip means are positioned in substantially aligned coextensive overlying relation relative to each other, only when the respective fugitive glue layers are brought into contact with each other. Each layer of fugitive glue is incapable of adhesion to other surfaces devoid of a mated layer of fugitive glue; therefore, in this particular embodiment, the top panel tear-strip means, prior to insertion of the enclosures, is initially folded back upon the top panel means and away from the back panel tear-strip means, preventing the layer of fugitive glue operably disposed upon the top panel tear-strip means from coming into unintended contact with the layer of fugitive glue operably disposed upon the back panel tear-strip means. Such a construction prevents the inadertent and premature affixation of the top panel tear-strip means to the back panel tear-strip means.

In a second alternative embodiment of the invention, the back panel tear-strip means, prior to insertion of the enclosures, is initially folded back upon the back panel means and away from the top panel tear-strip means, to prevent the layer of fugitive glue operably disposed on the back panel tear-strip means from coming into unintended contact with the layer of fugitive glue operably disposed on the top panel tear-strip means, thereby preventing inadvertent and premature affixation of the back panel tear-strip means to the top panel tear-strip means.

In another embodiment of the invention, the adhesive means comprises a layer of tackified glue operably arranged upon the top panel tear-strip means and a removable cover strip operably positioned over the layer of tackified glue for preventing inadvertent and premature affixation of the top panel tear-strip means to the back panel tear-strip means. Alternatively, the adhesive means comprises a layer of tackified glue operably arranged upon the back panel tear-strip means with a removable cover strip operably positioned over the layer of tackified glue for preventing inadvertent and premature affixation of the back panel tear-strip means to the top panel tear-strip means.

According to an alternative embodiment of the invention, the adhesive means comprises a layer of conventional envelope glue, operably positioned upon the top panel tear-strip means and which is tackified by moistening. This layer of conventional envelope glue may be operably and alternatively positioned upon the back panel tear-strip means.

In the preferred embodiment of the invention, the front panel means, the back panel means, the back panel tear-strip means and the top panel tear-strip means are all formed as a single contiguous envelope blank fabricated of paper material. In an alternative preferred embodiment of the invention, the front panel means, the back panel means, the back panel tear-strip means and the top panel tear-strip means are formed as a single contiguous envelope blank fabricated of plastic material.

DETAILED DESCRIPTION OF THE DRAWINGS

Figure 1:
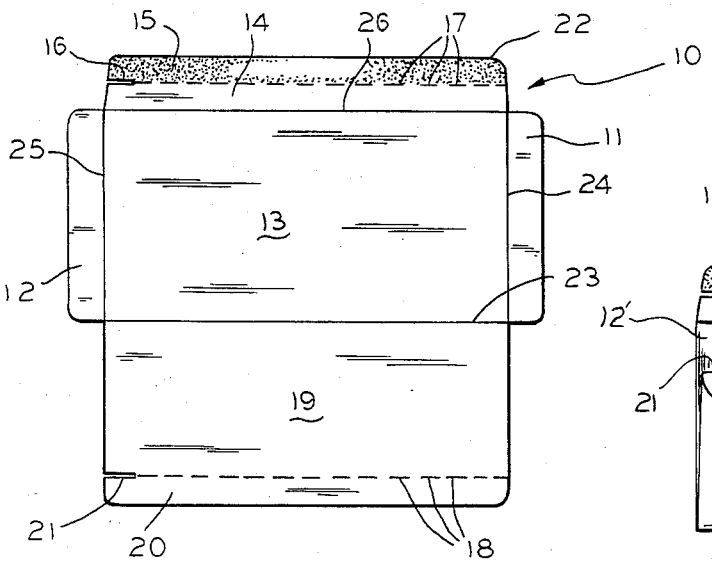
FIG. 1 is an elevated rear view of the tear-strip envelope apparatus in accordance with the present invention, comprising an unfolded envelope blank, and particularly showing the back panel tear-strip means, top panel tear-strip means and layer of fugitive glue thereon.

While this invention is susceptible of embodiment in many different forms, there is shown in the drawings and will herein be described in detail, a specific preferred embodiment, with the understanding that the present disclosure is to be considered as an exemplification of the principles of the invention and is not intended to limit the invention to the embodiment illustrated.

Tear strip opening envelope apparatus 10, in the preferred embodiment of the invention, is shown in FIG. 1 as an unfolded envelope blank prior to being folded and secured into its useful configuration. Tear-strip opening envelope apparatus 10 comprises front panel 13, the interior surface of which is shown. Back panel 19 emanates from the bottom side of front panel 13 and is formed contiguously therewith. Fold line 23 extends along the bottom side of front panel 13 and enables back panel 19 to be folded toward the interior surface of front panel 13. Back panel tear-strip 20 in turn emanates from back panel 19. Extending between back panel 19 and back panel tear-strip 20 is line of perforations 18. Notch 21 is provided between back panel 19 and back panel tear-strip 20 and is aligned with line of perforations 18, so as to enable the facilitated tearing of back panel tear-strip 20 from back panel 19.

Tear-strip opening envelope apparatus 10, according to a preferred embodiment of the invention, is also provided with side panels 11 and 12 which emanate contiguously from front panel 13. Fold lines 24 and 2 extend between side panels 11 and 12, respectively, and front panel 13. Emanating contiguously from the top side of front panel 13 is top panel 14. Fold line 26 extends along the top side of front panel 13 to enable top panel 14 to be readily folded toward the interior surface of front panel 13. Top panel tear-strip 22 emanates from top panel member 14 and has disposed thereon adhesive layer 15 which, in one embodiment of the invention, is fugitive glue, which adheres only to a surface upon which a mated layer of fugitive glue is disposed. Line of perforations 17 extends between top panel member 14 and top panel tear-strip member 22. Notch 6 is provided between top panel member 14 and top panel tears trip member 22 and is aligned with line of perforations 17 in order to provide facilitated tearing of top panel tear-strip member 22 from top panel 14, in a manner similar to that of back panel tear-strip 20.

Figure 2:
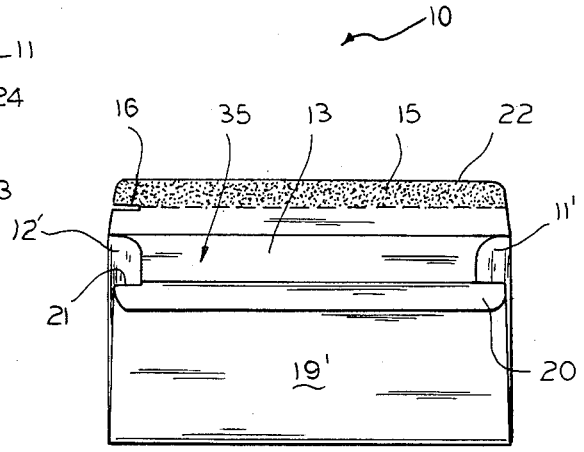
FIG. 2 is an elevated rear view of the tear-strip opening envelope apparatus according to FIG. 1, in which the envelope blank has been folded to initiate formation of a tear-strip opening envelope according to a preferred embodiment of the present invention and, showing the back panel tear-strip means folded down against the back panel means.

The assembly of the unfolded envelope blank of FIG. 1 into functioning tear-strip opening envelope apparatus 10 is shown in FIG. 2. Side panels 11' and 12' (11 and 12 in FIG. 1) have been folded toward front panel 13. Back panel 19' is folded up toward front panel 13 and affixed in place against side panels 11' and 12' by suitable attachment means (not shown) such as by gluing or stapling. Enclosures may be inserted into tear-strip opening envelope apparatus 10 through contents insertion region 35. Adhesive layer 15, preferably fugitive glue, remains exposed upon top panel tear-strip 22. A corresponding adhesive layer 30 of fugitive glue (seen in FIG. 3) is operably disposed upon the outwardly facing surface of back panel tear-strip 20. In order to prevent accidental or inadvertent sealing of tear-strip opening envelope apparatus 10, in the preferred embodiment of the invention, back panel tear-strip 20 is, prior to use, folded down toward back panel 19'. Since fugitive glue adheres only to other surfaces having fugitive glue disposed thereon, back panel tear-strip 20 may be folded upwards once the enclosures (not shown) have been inserted in contents insertion region 35.

Figure 3:
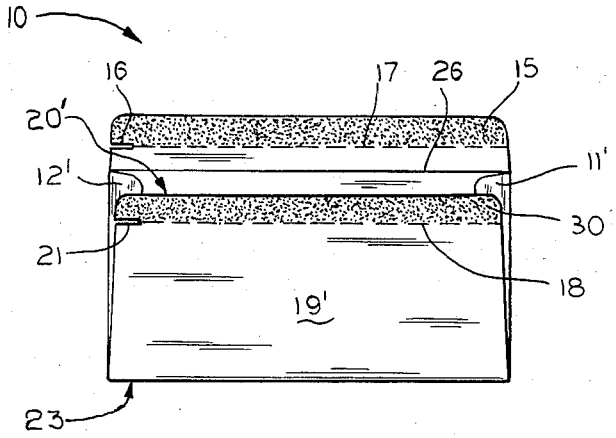
FIG. 3 is an elevated rear view of the tear-strip opening envelope apparatus according to FIG. 2, showing the back panel tear-strip means unfolded upwardly toward the top panel means to expose a layer of fugitive glue thereon.

Tear-strip opening envelope apparatus 10 is shown in FIG. 3 in condition ready to be sealed. Once enclosures 31 of FIG. 5 has been positioned within tear-strip opening envelope apparatus 10, back panel tear-strip 20' is folded up away from back panel 19' so as to expose fugitive glue layer 30 and line of perforations 18. Although side panels 11' and 12' are seen as extending from fold line 23 to fold line 26, it may be readily observed that ear-strip opening envelope apparatus 10 will function equally as well with side panels having lengths less than those shown.

Figure 4:
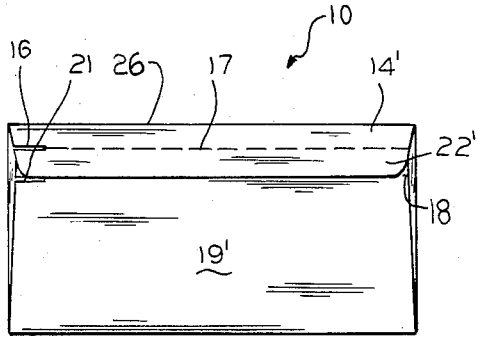
FIG. 4 is an elevated rear view of the tear-strip opening envelope apparatus according to FIG. 3, in a closed and sealed configuration, with the top panel tear-strip means overlying the back panel tear-strip means and affixed thereto.

In order to seal tear-strip opening envelope apparatus 10, as seen in FIG. 4, top panel member 14' is folded along fold line 26 over and toward back panel 19, Top panel tear-strip member 22' is thus brought into overlying registry with back panel tear-strip 20 thereby bringing adhesive layer 15 into contact with adhesive layer 30 (as suggested in FIG. 3). It may be readily understood from FIGS. 3 and 4 that the width of top panel tear-strip 22' from line of perforations 17 to its free edge is substantially equal to the width of back panel tear-strip 20 from line of perforations 18 to its free edge, so that when top panel tear-strip 22' is folded over and aligned with back panel tear-strip member 20, notch 16 is aligned with the top-most edge of back panel tear-strip member 20 (not shown in FIG. 4) and notch 21 is substantially aligned with the free edge 36 of top panel tear-strip 22'. Once tear-strip opening envelope apparatus 10 is sealed, the outer surfaces of top panel 14' and top panel tear-strip 22' extend and face in substantially the same directions as the outer surface of back panel 19'.

Figure 5:
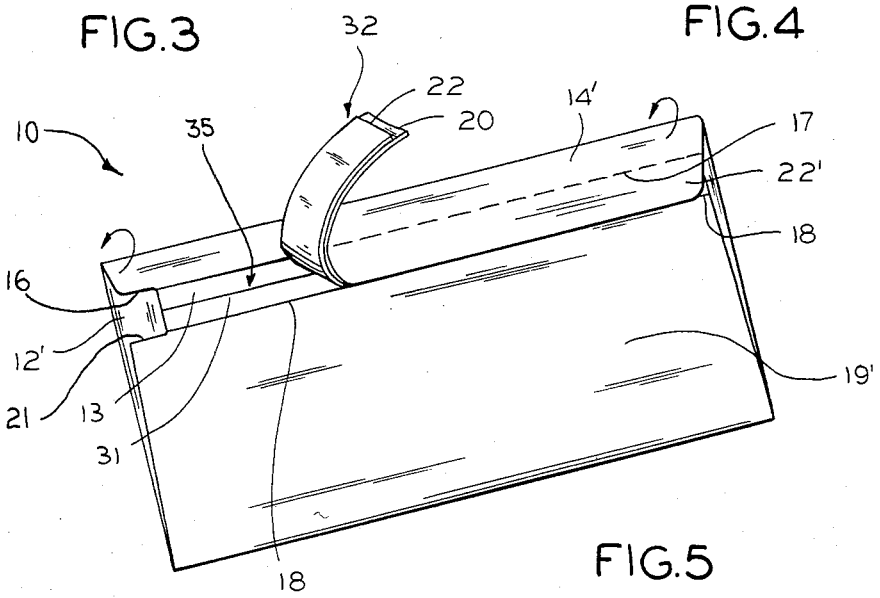
FIG. 5 is a rear perspective view of the tear-strip envelope apparatus according to FIG. 4, with the top panel tear-strip means overlying and affixed to the back panel tear-strip means. The operation of the joined top and back panel tear-strip means as a single reinforced multi-ply tear-strip member during opening of the envelope is particularly shown.

The opening of sealed tear-strip opening envelope apparatus 10 is shown in FIG. 5. Once back panel tear-strip 20 has been affixed to top panel tear-strip 22, by adhesive layers 15 and 30 (FIG. 3), reinforced multi-ply tear-strip 32 is formed. Separation of reinforced multi-ply tear-strip 32 from tear-strip opening envelope apparatus 10 is accomplished by lifting the end of reinforced multi-ply tear-strip 32, adjacent to notches 16 and 21 (portions of which are seen in FIG. 5) and pulling the end in the direction shown in FIG. 5. As the end of reinforced multi-ply tear-strip 32 is drawn across tear-strip opening envelope apparatus 10, top panel tear-strip 22 is torn away from top panel 14' along line of perforation 17 while, simultaneously, back panel tear-strip 20 is torn away from back panel member 19' along line of perforation 18. Contents insertion region 35 is again exposed, enabling visual inspection of enclosures 31 within tear-strip opening envelope apparatus 10. In order to remove enclosures 31, reinforced multi-ply tear-strip 32 is drawn across tear-strip opening envelope apparatus 10 as shown until reinforced multi-ply tear-strip 32 is separated from tearstrip opening envelope apparatus 10 along lines of perforation 17 and 18 a sufficient amount to permit top panel 14' to be unfolded, in the direction of the arrows, away from contents insertion region 35, to enable enclosure 31, for example, to be removed. It may be observed that since, after opening, top panel 14' remains intact, tear-strip opening envelop apparatus 10 may continue to be utilized for the retention and storage of enclosures, though without the capacity to be resealed.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention. For example, it may be readily understood that the fugitive glue used in the embodiment shown herein may be replaced, without departing from the spirit and scope of the invention, either by a layer of tackified glue, disposed either on top panel tear-strip 20' or on back panel tear-strip 15 (as seen in FIG. 3), having a removable protective cover strip positioned over the layer of tackified glue to prevent unintended sealing of the top and back panel tear-strip. Similarly, conventional dry envelope glue, which is tackified by moistening, may be substituted for the tackified glue and removable protective cover strip and positioned as described. It may also be readily observed that the invention herein may be fabricated from any suitable foldable material, such as paper, cardboard or flexible plastic.

What is claimed is:

1. A tear-strip opening envelope apparatus for the protective maintenance of enclosures therewithin, in which said apparatus is configured for the facilitated closing, sealing, opening and emptying thereof, and for subsequent storage of enclosures as desired, said tear-strip opening envelope apparatus comprising:

front panel means having a top and bottom side opposite one another;

back panel means having a top and bottom side opposite one another, said back panel means being positionable in a substantially overlying relation to said front panel means, said front panel means and said back panel means being joined along at least a substantial portion of their respective bottom sides to define a contents enclosure region, with a remaining unjoined portion proximate to the respective top sides of both said front and back panel means defining a contents insertion region substantially opposite to said joined bottom sides;

back panel tear-strip means operably emanating from said back panel means for covering at least a portion of said contents insertion region, said back panel tear-strip means being capable of being separated in a facilitated manner from said back panel means;

top panel means operably emanating from the top side of said front panel means and covering at least a portion of said contents insertion region upon folding back of said top panel means over said front panel means;

top panel tear-strip means operably positioned along at least a portion of said top panel means, said top panel tear-strip means being capable of being separated in a facilitated manner from said top panel means, said to panel tear-strip means being disposed at a position removed from said top side of said front panel means, said back panel tear-strip means and said top panel tear-strip means being positioned in substantially congruent overlying registry relative to each other upon juxtapositioning of said back and top panel means with both of said top and back panel means being folded over the front panel means prior to separation of said back and top panel tear-strip means from said back and top panel means respectively, said back panel tear-strip means and said top panel tear-strip means having adhesive means operably positioned between the overlying regions thereof, for restrainably affixing said back panel tear-strip means to said top panel tear-strip means, thereby sealing said top and back panel means to each other and, in turn, said envelope apparatus, with said enclosures therewithin, while simultaneously forming a reinforced multi-ply tear-strip member for facilitated opening of said envelope apparatus, said sealed envelope apparatus being openable by grasping said reinforced multi-ply tear-strip member at a first end thereof and pulling said first end across said apparatus until said reinforced multi-ply tear-strip member is separated from said apparatus to the extent needed to expose said enclosures for facilitated removal thereof, and said top panel means remaining substantially intact upon separation of said reinforced multi-ply tear-strip member from said apparatus.

2. The invention according to claim 1 wherein said tear-strip opening envelope apparatus further comprises side panel means operably emanating from at least one of said front and back panel means, between the respective top and bottom sides thereof, for operable positioning between said front panel means and said back panel means towards further enclosing said contents enclosure region.

3. The invention according to claim 1 wherein said front panel means comprises a substantially rectangular panel.

4. The invention according to claim 1 wherein said back panel means comprises a substantially rectangular panel having a width substantially equal to that of said front panel means and having a height substantially less than that of said front panel means.

5. The invention according to claim 4 wherein said back panel means is formed contiguously with said front panel means along a fold line positioned at said bottom sides of said front and back panel means, whereby folding said contiguously formed front and back panel means along said fold line toward each other positions said front and back panel means in said substantially overlying position relative to each other.

6. The invention according to claim 1 wherein said back panel tear-strip means comprises a substantially rectangular strip formed contiguously with said back panel means and having at least one line of perforations extending therebetween.

7. The invention according to claim 6 wherein said line of perforations extending between said back panel means and said back panel tear-strip means extends to at least one side of said back panel means; and said back panel means and said back panel tearstrip means have, operably disposed therebetween at said side of said back panel means, a notch for facilitating said grasping and pulling of said reinforced multi-ply tear-strip member across said tear-strip.

8. The invention according to claim 1 wherein said top panel means is formed contiguously with said front panel means along a fold line positioned at said common peripheral region, whereby folding said top panel means along said fold line toward and over said front panel means prompts said top panel means to cover at least a portion of said envelope contents insertion region.

9. The invention according to claim 8 wherein said top panel tear-strip means comprises a substantially rectangular panel formed contiguously with said top panel means and having at least one line of perforations extending therebetween.

10. The invention according to claim 9 wherein said line of perforations extending between said top panel means and said top panel tear-strip means extend to at least one side of said top panel means; and said top panel means and said top panel tear-strip means have operably disposed therebetween at said end a notch for facilitating said grasping and pulling of said reinforced multi-ply tear-strip member across said tearstrip opening envelope apparatus.

11. The invention according to claim 1 wherein said adhesive means comprises a layer of fugitive glue operably disposed upon each of said top panel tear-strip means and said back panel tear-strip means so as to restrainably affix same to each other when said top panel tear-strip means and said back panel tear-strip means are positioned in said substantially congruent overlying registry relative to each other, when said respective fugitive glue layers are brought into contact with each other, each said layer of fugitive glue being incapable of adhesion to other surfaces devoid of a mated layer of said fugitive glue.

12. The invention according to claim 11 wherein said top panel tear-strip means, prior to insertion of said enclosures, is initially folded back upon said top panel means and away from said back panel tear-strip means, so as to prevent said layer of fugitive glue operably disposed on said top panel tear-strip means, from coming into unintended contact with said layer of fugitive glue operably disposed on said back panel tear-strip means, thereby preventing inadvertent and premature affixation of said top panel tear-strip means, to said back panel tear-strip means.

13. The invention according to claim 11 wherein said back panel tear-strip means, prior to insertion of said enclosures, is initially folded back upon said back panel means and away from said top panel tear-strip means, so as to prevent said layer of fugitive glue operably disposed on said back panel tear-strip means, from coming into unintended contact with said layer of fugitive glue operably disposed on said top panel tear-strip means, thereby preventing inadvertent and premature affixation of said back panel tear-strip means to said top panel tear-strip means.

14. The invention according to claim 1 wherein said adhesive means comprises:

a layer of tackified glue operably arranged upon said top panel tear-strip means; and a removable cover strip operably positioned over said layer of tackified glue for preventing inadvertent and premature affixation of said top panel tear-strip means to said back panel tear-strip means.

15. The invention according to claim 1 wherein said adhesive means comprises:

a layer of tackified glue operably arranged upon said back panel tear-strip means; and a removable cover strip operably positioned over said layer of tackified glue for preventing inadvertent and premature afffixation of said back panel tear-strip means to said top panel tear-strip means.

16. The invention according to claim 1 wherein said adhesive means comprises a layer of conventional envelope glue operably positioned upon said top panel tear-strip means and which is tackified by moistening.

17. The invention according to claim 1 wherein said adhesives means comprises a layer of conventional envelope glue operably positioned upon said back panel tear-strip means and which is tackified by moistening.

18. The invention according to claim 1 wherein said front panel means, said back panel means, said back panel tear-strip means and said top panel tear-strip means are formed as a single contiguous envelope blank of paper material.

19. The invention according to claim 1 wherein said front panel means, said back panel means, said back panel tear-strip means and said top panel tear-strip means are formed as a single contiguous envelope blank of plastic material.

* * * * *

UNITED STATES PATENT AND TRADEMARK OFFICE

CERTIFICATE OF CORRECTION

PATENT NO. : 4,819,807

DATED : April 11, 1989

INVENTOR(S) : Giger

It is certified that error appears in the above-identified patent and that said Letters Patent is hereby corrected as shown below:

| | |
|---|---|
| Col. 3, line 6 | "multiply" should be instead -- multi-ply -- |
| Col. 5, line 20 | "inadertent" should be instead -- inadvertent -- |
| Col. 6, line 59 | "2" should be instead -- 25 -- |
| Col. 7, line 39 | "ear-strip" should be instead -- tear-strip -- |
| Col. 7, line 44 | "19," should be instead -- 19'. -- |
| Col. 9, line 17 | "to" should be instead -- top -- |
| Col. 10, line 14 | "tearstrip" should be instead -- tear-strip -- |

Signed and Sealed this

Ninth Day of July, 1991

*Attest:*

*Attesting Officer*

HARRY F. MANBECK, JR.

*Commissioner of Patents and Trademarks*